US009861191B1

(12) United States Patent
Song

(10) Patent No.: US 9,861,191 B1
(45) Date of Patent: Jan. 9, 2018

(54) BILLIARD TABLE LEVELING DEVICE

(71) Applicant: JIANGXI RASSON BILLIARD MANUFACTURING CO. LTD., Jiujiang, Jiangxi (CN)

(72) Inventor: Jin Song, Jiujiang (CN)

(73) Assignee: JIANXI RASSON BILLIARD MFG. CO. LTD., Jianxi (CN)

( * ) Notice: Subject to any disclaimer, the term of this patent is extended or adjusted under 35 U.S.C. 154(b) by 0 days.

(21) Appl. No.: 15/239,465

(22) Filed: Aug. 17, 2016

(51) Int. Cl.

| | |
|---|---|
| ***A63D 15/00*** | (2006.01) |
| ***A63J 3/00*** | (2006.01) |
| ***A47B 13/08*** | (2006.01) |
| ***A47B 37/00*** | (2006.01) |

(52) U.S. Cl.
CPC ..... *A47B 13/081* (2013.01); *A47B 37/00* (2013.01); *A63D 15/00* (2013.01)

(58) Field of Classification Search
CPC ..... A63D 15/00; A47B 37/00; A47B 13/081
USPC ..... 473/10, 29, 20, 33, 22, 15; 248/188.4; 108/147, 161
See application file for complete search history.

(56) References Cited

U.S. PATENT DOCUMENTS 43,829 A * 8/1864 Bradley ..... A63D 15/04 473/10
372,566 A * 11/1887 Rice ..... E04G 17/0721 254/104
464,921 A * 12/1891 Carr ..... B63B 9/00 144/129
875,775 A * 1/1908 Burhorn ..... E04F 15/02488 220/3.7
921,651 A * 5/1909 Bracher ..... A63D 15/00 473/29
1,624,243 A * 4/1927 Hoff ..... B66F 7/243 248/352
1,875,198 A * 8/1932 Nagai ..... A63F 7/0023 273/108.2
2,164,615 A * 7/1939 Mafera ..... F16M 7/00 254/104
2,524,961 A * 10/1950 Cramer, Jr. ..... F01B 17/04 254/104
3,030,729 A * 4/1962 Elden ..... A63D 15/00 108/147
3,171,632 A * 3/1965 Jines ..... F16M 7/00 254/104
3,455,551 A * 7/1969 Untiedt ..... A63D 15/00 473/22
3,837,298 A * 9/1974 Leonhart ..... A47B 25/003 108/161
4,027,878 A * 6/1977 Dadbeh ..... A63D 15/00 473/29
4,808,147 A * 2/1989 Graham ..... B62K 19/34 384/431
4,989,863 A * 2/1991 Hall ..... A63D 15/00 473/15
5,090,664 A * 2/1992 McCullough ..... B23Q 1/0054 254/104
5,249,767 A * 10/1993 Mellen ..... F16M 7/00 248/188.2
5,839,966 A * 11/1998 Eisenhauer ..... A63D 15/00 473/29

(Continued)

*Primary Examiner* — Mitra Aryanpour

(57) ABSTRACT

The present invention is pool or billiard table having a system of multiple local section, wedge leveling devices secured in recesses in a support frame, which allow a user to precisely and in very small increments adjust sectionwise leveling of a slate slab.

9 Claims, 5 Drawing Sheets

(56) References Cited

U.S. PATENT DOCUMENTS

| | | | | | |
|---|---|---|---|---|---|
| 5,882,265 | A * | 3/1999 | Benton | A63D 15/00 | 473/15 |
| 6,132,320 | A * | 10/2000 | Spoerl | A63D 15/00 | 473/29 |
| 6,244,969 | B1 * | 6/2001 | Murphy | A63D 15/00 | 473/29 |
| 7,654,911 | B2 * | 2/2010 | Cartwright | A47B 91/022 | 473/1 |
| 7,703,727 | B2 * | 4/2010 | Selness | A47B 91/028 | 248/125.2 |
| 7,828,668 | B1 * | 11/2010 | Tippit | A63D 15/00 | 473/10 |
| 8,550,929 | B1 * | 10/2013 | Nebauer-McRae | A63D 15/00 | 473/1 |
| 8,827,823 | B1 * | 9/2014 | Sullivan | A63D 15/00 | 473/29 |
| 2008/0156235 | A1 * | 7/2008 | Keirstead | A47B 13/003 | 108/146 |
| 2009/0270191 | A1 * | 10/2009 | Cartwright | A63D 15/00 | 473/33 |

* cited by examiner

BILLIARD TABLE LEVELING DEVICE

FIELD OF THE INVENTION

The present invention is broadly directed to leveling of a slate slab or slabs as horizontal playing surface for a billiards sport table, and, more particularly to devices and a method for highly localized control of leveling of that slate slab.

BACKGROUND OF THE INVENTION

A variety of playing surfaces require leveling in order to permit proper movement of playing pieces thereon. Certain games, such as billiards and pool and the like, are very sensitive to proper leveling in order to fairly allow the balls to travel on the surface. Specifically, the preferred playing surface of a billiard or pool table is a smooth, horizontal slab of slate up to six by nine feet in width and length and from three quarters to one inch thick. The weight of this slab (apart from that substantial structure and frame to support it) can weigh up to 900 pounds.

The billiard sports comprise sports using a cue and a table for individual games such as billiards, pool, carom, and snooker, where tables for carom and snooker are generally larger than the pool table.

The width of slates for these tables can be shorter than six feet, the length can be longer than nine feet, the thickness can be thinner or thicker than one inch. Some pool tables comprise a slate with a thickness of around one and one fourth inches. For the snooker and carom tables, the width, the length, the thickness are much different than for a pool table, where the thickness for snooker and carom tables are often at 45 mm, 50 mm, or 60 mm.

the slates size could be any width, any length, any thickness.

The slate slab may be provided in a single piece or in a number of pieces which are positioned side by side on top of a support frame, typically having two horizontal, lengthwise outer sections joined with multiple cross pieces, where the support frame is thereby supported by at least four sturdy legs. It is common that, for the purposes of maintaining a level playing surface for pool or billiard balls, the playing surface of the slate slab is generally not level with respect to the overall frame, or it is locally not level with respect to horizontal portions of the slate slab.

Such local variations in leveling of the slate slab is predictable, in that the pool table support frame is usually made of some type of wood, which expands and contracts with humidity and compresses differentially across its horizontal support structure over years of support not only the weight of the slate slab, but also the constant upper body compression applied to it by pool players, which compression is most likely to be greatest in a central area of the slate slab.

There is a need for a carefully distributed set of leveling devices across the underside surface of the slate slab easily operable to perform local leveling of small portions of the horizontal sections of a pool table, but which are also have increased density of leveling devices across a central section of the slate slab.

SUMMARY OF THE INVENTION

The present invention is pool or billiard table having a system of multiple local section, wedge leveling devices secured in recesses in a support frame, which allow a user to precisely and in very small increments adjust sectionwise leveling of a slate slab.

Further, the invention system provides for hiding the wedge leveling devices by way of the nature of the wedge leveling devices being accessible for adjustment by way of horizontal access to the head of an adjusting bolt and reducing the overall size of the wedge leveling devices for secreting them away in the recesses created in the support frame pieces.

The wedge leveling devices have a wedge piece and a corresponding wedge incline integral with a device box, which has an open top and a floor defining the wedge incline. A drive mechanism comprises an adjustment bolt that is threadedly engaged with one end of the device box so that a distal end of the adjustment bolt is engaged in the wedge piece and turning the adjustment bolt results in movement of the wedge piece up or down on the wedge incline, thereby causing a cover piece to respectively lift or lower a local section of a slate slab located just above the cover piece.

With respect to locations of the invention leveling wedge devices with respect to the support frame, a unique combination of head-to-head arrangement of two invention wedge leveling devices for a single local section of the slate slab is disclosed for cross-pieces of the support frame, recognizing that the additional compression and stress upon the central sections of the slate slab away from a peripheral section of the frame will regularly receive impression of nearly the full upper body weight of a player, requiring a greater degree of fine adjustment to that local section as provided by two closely located wedge leveling devices.

It is an object of the invention to provide fine, small increment leveling adjustment to a pool or billiard table by way of multiple wedge leveling devices located in recesses in a support frame in peripheral and cross piece parts of that support frame.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

DETAILED DESCRIPTION OF THE INVENTION

It is to be understood that while certain forms of the present invention have been illustrated and described herein, it is not to be limited to the specific forms or arrangement of parts described and shown.

Figure 1:
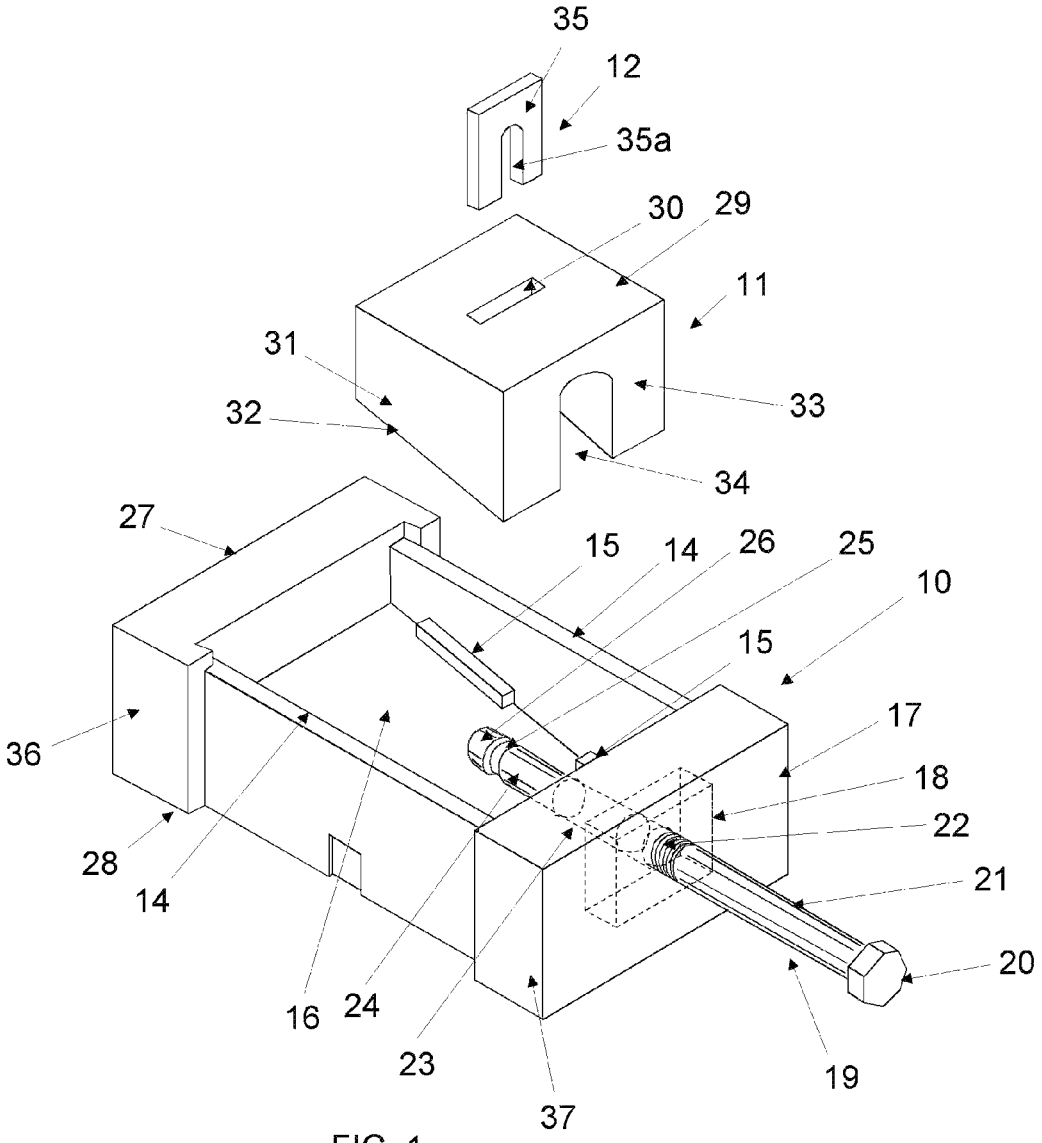
FIG. 1 is an exploded, perspective view of a wedge leveling device according to the invention.
Figure 4:
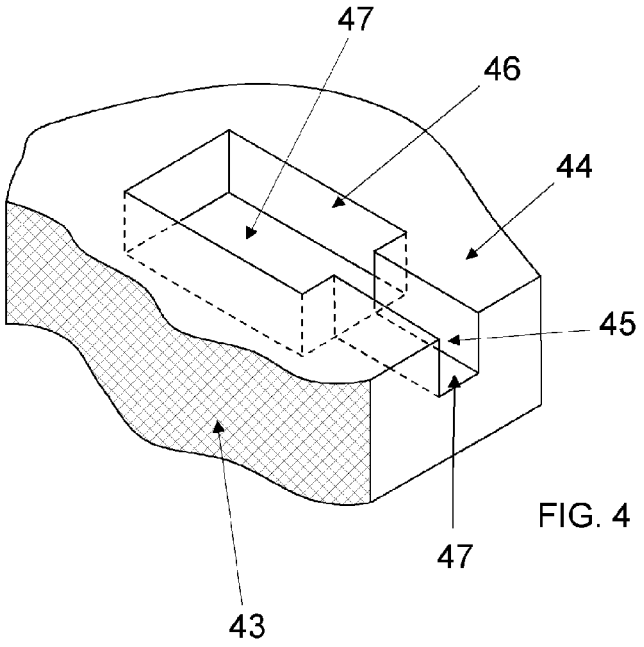
FIG. 4 is a perspective view of a recess in the support frame shown in cutaway view in FIG. 3.

FIG. 1 is an exploded, perspective view of a wedge leveling device according to the invention comprising a support box 10, a wedge piece 11, and a lock piece 12. Support box 10 comprises side walls 14, front section 17 and rear section 27, defining a space between them and having a floor forming a wedge incline surface 16. Side walls 14 comprise guides 15 that are integral with wedge incline surface 16 and are adapted to guide wedge piece 11 along wedge incline surface 16 when its bottom surface 32 is engaged with the wedge incline surface 16 in operation. Sections 17 and 27 respectively comprises sides 37 and 36, which, along with bottom surface 28 of support box 10, respectively contact side walls and a floor of a support frame recess parts 45 and 46 (as shown in FIG. 4).

Referring again to FIG. 1, bolt 19 comprises a head 20, an outer shaft 20, a threaded inner shaft 23 (shown in broken lines), and an end shaft 24 (in which is defined a lock groove 25, which is adapted to engage inside surfaces of slot 35*a* of lock tab 12, where slot 35*a* is defined in the body 35 of lock tab 12). Optionally, a threaded nut 18 (shown in broken lines) is fixed within the front section 17 to threadedly engage threaded inner shaft 23 so that rotation of head 20 causes bolt 19 to move inward or outward with respect to front section 17.

Wedge piece 11 comprises a bottom incline surface 32 adapted to substantially surround end shaft 24, thereby allowing tab 12 to be inserted in through slot 30 to lock wedge piece 11 to bolt 19 at groove 25, when the separated pieces of FIG. 1 are engaged together. Wedge piece 11 further comprises a front face 33 which is adapted to oppose an inside surface of section 17 when properly connected with support box 10 and sidewalls 31 also adapted to slidingly engage and be guided by guides 15 when wedge piece 11 is urged up or down wedge incline surface 16 in operation.

Figure 2:
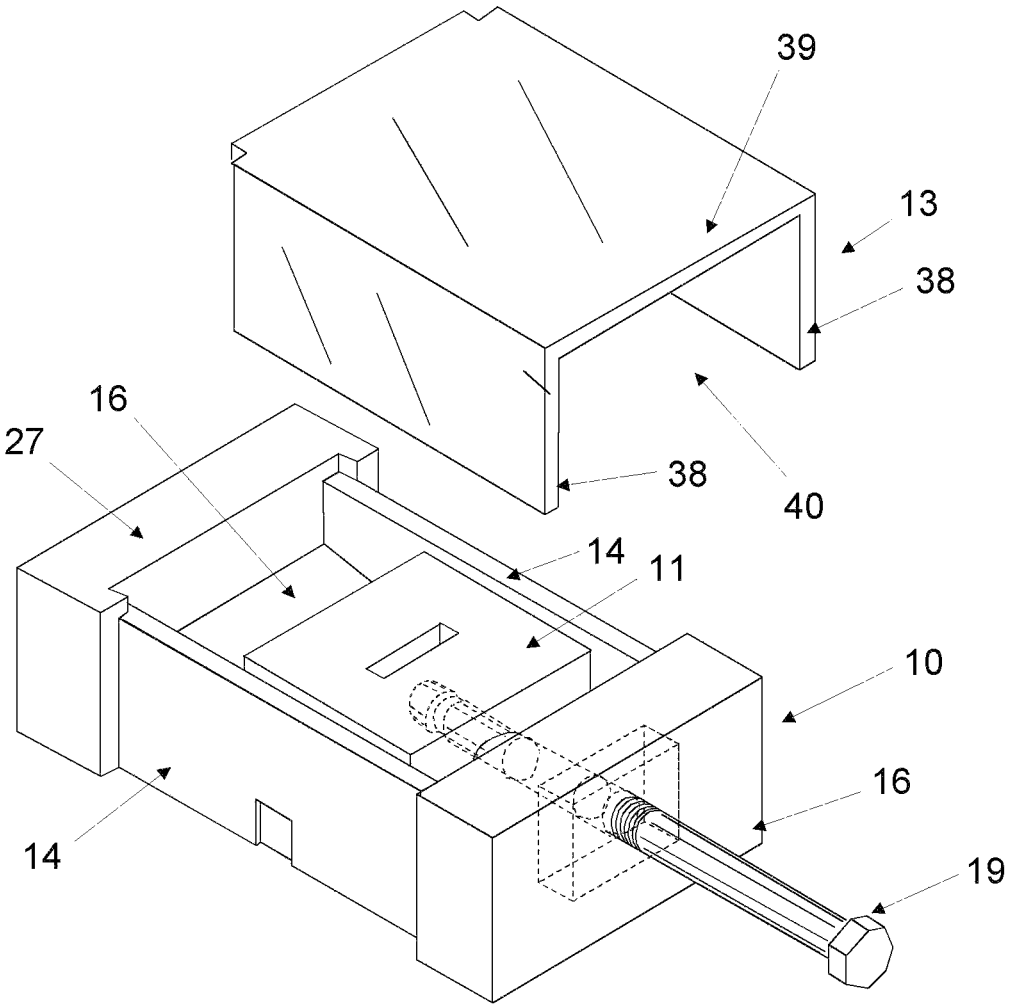
FIG. 2 is a perspective view of the wedge leveling device of FIG. 1 with a cover piece shown in an exploded position.

FIG. 2 is a perspective view of the wedge leveling device of FIG. 1 with a cover piece 13 shown in an exploded position relative to the assembled support box 10, bolt 19, wedge piece 11, and tab 12 (not shown, but having been inserted into slot 30). Cover piece 13 comprises a U-shape cross section piece having side walls 38 and a top joining section 39. Inside surfaces of sidewalls 38 engage outside surfaces of sidewalls 14 of support box 10 then cover piece 13 is properly assembled, whereby an underside of top joining section 39 contacts the top surface 29 of wedge piece 11, thereby resulting in a fully assembled wedge leveling device.

Figure 3:
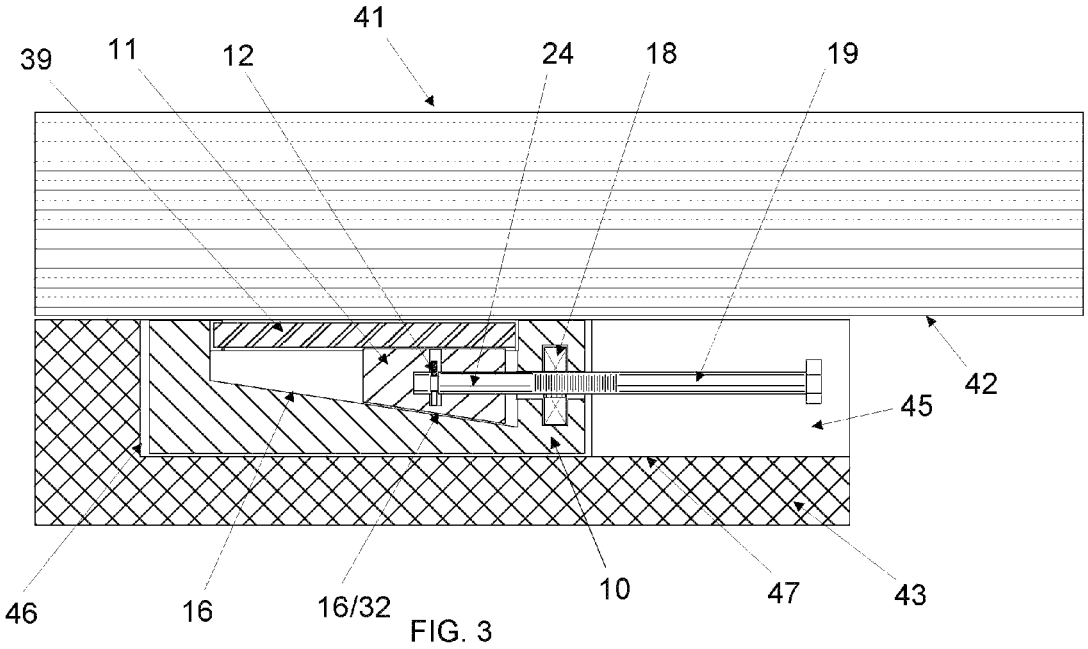
FIG. 3 is a side and cutaway view of the wedge leveling device of FIGS. 1 and 2 assembled and located in a recess in a support frame, which the assembly of which supports a slate slab (shown in side and cutaway view) so that the cover piece can be raised to provide local leveling of the slate slab.

FIG. 3 is a side and cutaway view of the wedge leveling device of FIGS. 1 and 2 assembled and located in a recess (comprising sections 45 and 46) in a support frame 43, which the assembly of which supports a slate slab 41 (shown in side and cutaway view) so that the cover piece 13 (of which top joining section 39 is shown in cross section and contacting slab underside 42 can be raised or lowered to provide local leveling of the slate slab 41, by rotation of bolt 19, whereby the entire wedge leveling device is not integrally part of the support frame 43 but merely rests upon floor 47 of sections 45 and 46. In preferred embodiments, a top surface of top joining section 39 is equal or less than 3 inches by 3 inches, more preferably equal to less than 1.5 inches by 1.5 inches to accomplish the objects of the invention of highly local leveling of slab 41.

FIG. 4 is a perspective view of a recess in the support frame 43 (shown in cutaway view) where the recess is defined by a large section 46 adapted to contain the support box 10 covered with the cover piece 13 and access section 47 is defined by a smaller recess with openings into large section 46 and an outside surface of support frame 43, whereby a user can insert a tool, such as a ratchet bearing an appropriately sized socket, to rotate the head of bolt 19 to cause wedge piece 11 to move up or down wedge incline surface 16, thereby further causing cover piece 13 to rise or lower with respect to underside 42 of slab 41 and adjust local leveling thereby. Support frame 43 comprises multiple recesses comprised of sections 45 and 46, preferably uniformly along peripheral sections and cross pieces of the support frame 43.

Figure 5:
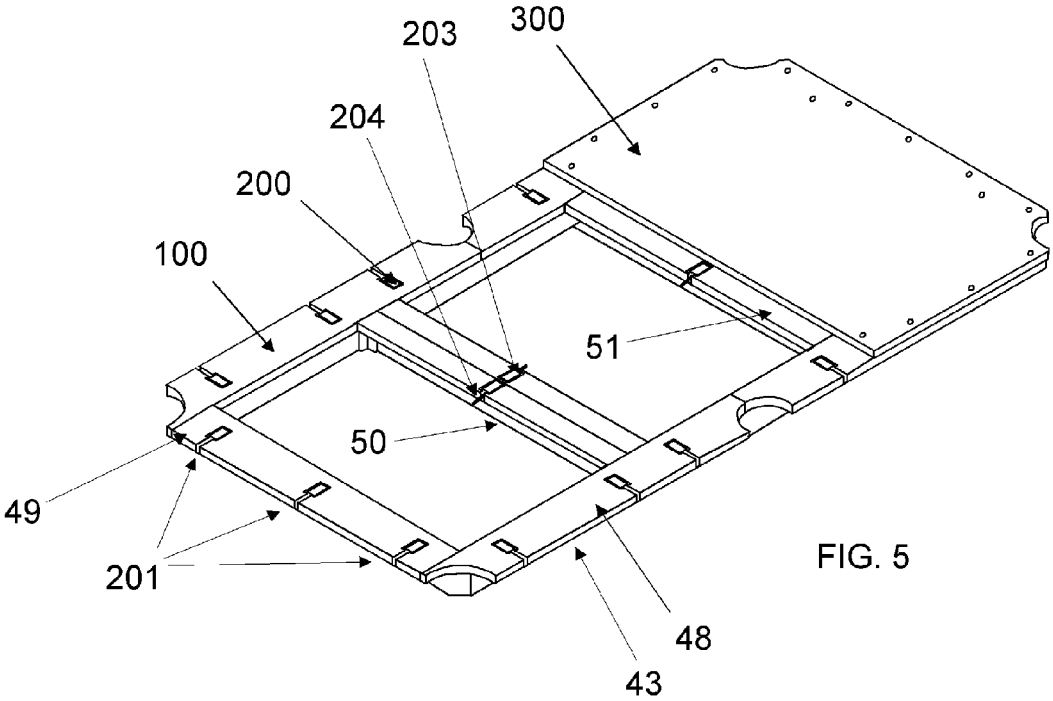
FIG. 5 is a perspective view of a support frame and a portion of a slate slab with recesses in the support frame supporting and enclosing wedge leveling devices.

FIG. 5 is a perspective view of a support frame and a portion of a slate slab with recesses in the support frame 43 supporting and providing recesses for the invention wedge leveling devices. End frame 49 is shown with three recesses 201. Side frames 100 comprise engaged cross pieces 50 and 51, whereby recesses 200 are formed adjacent to the location where cross pieces 50 and 51 engage with side frames 100. Further, head to head recesses 203 and 204 are formed in a center part of cross pieces 50 and 51, whereby recesses 200, 203 and 204 comprise an operative group of locations for the invention wedge leveling devices so that leveling of the essentially continuous support surface of the cross pieces 50 and 51 and their connection locations to side frames 100 can be most effectively controlled.

Alternate Specific Description

Figure 6:
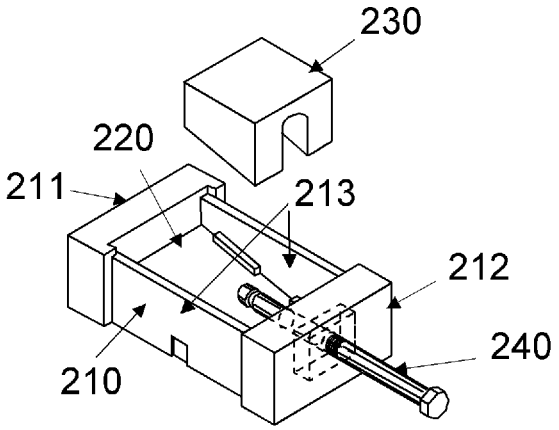
FIGS. 6, 7 and 8 are alternate representations of wedge leveling devices in FIGS. 1 and 2.
Figure 7:
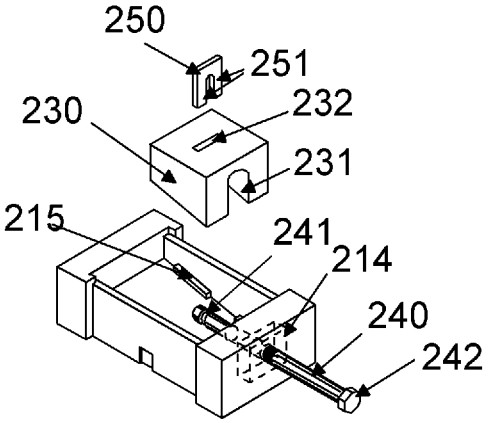
Figure 8:
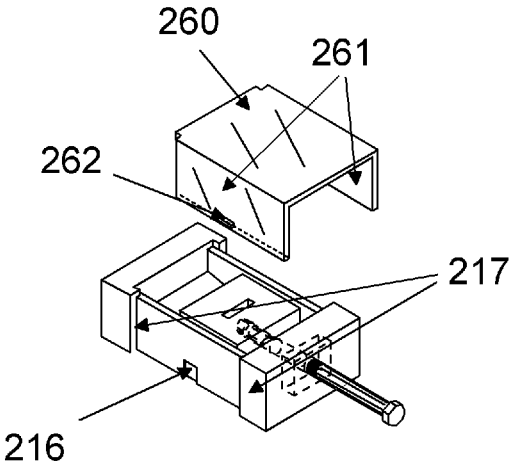

FIGS. 6, 7 and 8 are alternate representations of wedge leveling devices in FIGS. 1 and 2.

With reference to FIGS. 5 and 6, invention leveling equipment consists of main panel 100, cover panel 300 and several of LevelBox 200. The LevelBox has pedestal 210, the first shift block 220, the second shift block 230, the bolt 240. The pedestal 210 is a top opening box which has front wall 211, back wall 212, side walls 213. The first shift block 220 is with high front and low back surface. When the bolt 240 shift around the main axis, it drives the second shift block 230 to move along the high and low surface on first shift block 220. There is the screw thread in the hole on the back wall 212. The first end of bolt 240 connects back wall 212, the second end connects the second shift block 230. Through the high and low surface on the first shift block 220, the vertical pressure from the cover panel 300 can change into the horizontal power on bolt 240. Through the horizontal power and the pressure, friction from first shift block 220 to the second shift block 230, with all these powers to support the cover panel 300 which reduce the effects to the bolt 240, further to protect the bolt 240.

With reference to FIG. 7, on a second shift block 230, there is a latch 250, a fillister 231, the second hole 232, stuck piece 251. There is a circle groove 214 on the second end of bolt 240; a lead rail 215 set on the side wall 213. The lead rail 215 set on side wall 213, parallel with the surface of first shift block 220. A location limitation part (not shown) is located between the second shift block 230 and lead rail 215. There may be the ball bearing on the lead rail 215 so as to reduce the friction during the moving of second shift block 230, further for the convenient leveling. Based on need, inlayed nut 214 may be located in the first hole. It can enhance the strength of the screw thread to prolong the using life.

With reference to FIG. 8, there is a top cover 260, set atop and move with the second shift block 230. Also side blocks 261 which are inside side walls 213. Slot 216 and the location limitation part 217 set on both side walls 213. The fastener 262, set inside side blocks 261. Slot 216 and fastener 262 to control the shifting highest height of top cover 260 to avoid derail.

What is claimed is:

1. A playing table, for pool or billiards with legs supporting a support frame, which in turn supports a horizontal playing slab with a level top playing surface comprising:

(a) the support frame having a peripheral rectangular section and cross pieces that connect longer opposing parts of the peripheral rectangular section, where the peripheral rectangular section and the cross pieces have side walls;

(b) multiple recesses are defined in a top surface of the support frame and cross pieces, each recess defining a box section in a center part of the support frame or cross piece and each box section being continuous with an access section that defines an opening in a side wall and an opening into the box section; and (c) one or more wedge leveling devices, each fixed within one of the recesses under a bottom surface of the horizontal playing slab and each having a support box with a wedge incline surface as a floor of a wedge space lower at a front part and higher toward a rear part and open to a top surface of the support box and a threaded adjuster fixed in a front wall of the support box where the support box is fixed within the box section; and (d) each wedge leveling device further comprising a wedge piece located in the wedge space and having a bottom inclined surface slidably engaged to the floor of the wedge incline surface, where the wedge piece is further engaged to the end of a rotatable bolt that is engaged with the threaded adjuster and extends into the access section terminating in a bolt head.

2. The playing table of claim 1 wherein recesses with wedge leveling devices are located only in the peripheral section of the support frame.

3. The playing table of claim 1 wherein recesses with wedge leveling devices are located only in the cross pieces of the support frame.

4. The playing table of claim 1 wherein recesses with wedge leveling devices are located in the peripheral section and cross pieces of the support frame.

5. The playing table of claim 4 wherein an operational group of recesses with wedge leveling devices are located at a center section of one or more cross pieces.

6. The playing table of claim 5 wherein the operational group consists of two recesses with wedge leveling devices arranged head to head at the center section of one or more cross-pieces.

7. The playing table of claim 6 wherein the operational group further consists of two recesses with wedge leveling devices are arranged at the peripheral section where each is adjacent to a side of one of two connection sections of the cross piece to the peripheral section, resulting in the operational group consisting of a total of six recesses with wedge leveling devices.

8. The playing table of claim 1 wherein a top surface of a cover piece located above a top surface of a wedge piece is equal to or less than 3 inches by 3 inches.

9. The playing table of claim 1 wherein a top surface of a cover piece located above a top surface of a wedge piece is equal to or less than 1.5 inches by 1.5 inches.

* * * * *